US010137497B2

(12) United States Patent
Takahashi et al.

(10) Patent No.: US 10,137,497 B2
(45) Date of Patent: Nov. 27, 2018

(54) CASTING DIE

(71) Applicant: HONDA MOTOR CO., LTD., Tokyo (JP)

(72) Inventors: Toshihiro Takahashi, Tochigi (JP); Kenichi Shuto, Tochigi (JP); Masayuki Hattori, Tochigi (JP); Hiroshi Takahashi, Tochigi (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/548,650

(22) PCT Filed: Feb. 8, 2016

(86) PCT No.: PCT/JP2016/053633
§ 371 (c)(1),
(2) Date: Aug. 3, 2017

(87) PCT Pub. No.: WO2016/129547
PCT Pub. Date: Aug. 18, 2016

(65) Prior Publication Data

US 2018/0056379 A1 Mar. 1, 2018

(30) Foreign Application Priority Data

Feb. 9, 2015 (JP) ..... 2015-023096

(51) Int. Cl.
*B22C 9/06* (2006.01)
*B22D 15/02* (2006.01)
(Continued)

(52) U.S. Cl.
CPC ..... *B22D 17/002* (2013.01); *B22C 9/06* (2013.01); *B22D 15/02* (2013.01); *B22D 17/22* (2013.01); *B22D 18/04* (2013.01)

(58) Field of Classification Search
CPC ..... B22C 9/06; B22C 9/062; B22D 17/002; B22D 17/22; B22D 15/02; B22D 18/04; B29C 45/1742; B29C 45/1743
See application file for complete search history.

(56) References Cited

U.S. PATENT DOCUMENTS 8,646,512 B2 * 2/2014 Layton ..... B22D 17/266 164/340
2006/0157217 A1 * 7/2006 Bassi ..... B22D 18/04 164/119

FOREIGN PATENT DOCUMENTS

GB 2208817 A * 4/1989 ..... B22C 9/061
JP 09-094652 4/1997
(Continued)

OTHER PUBLICATIONS

International Search Report, dated Apr. 26, 2016 (Apr. 26, 2016), 1 page.

*Primary Examiner* — Kevin E Yoon
(74) *Attorney, Agent, or Firm* — Rankin, Hill & Clark LLP

(57) ABSTRACT

Provided is a casting die 1 including a base 3, a lower mold 4, a horizontal sliding mold 5, and an upper mold 6. The lower mold 4 is configured by a lower mold body 10 and a lower mold stage 11. A guide member 17 is mounted on the lower mold stage 11 so as to freely move in the up and down direction with respect to the lower mold stage 11. The horizontal sliding mold 5 is configured to slide on the guide member 17 and the lower mold body 10. The guide member 17 is provided with a locking part **17*a* which locks with a lateral edge part of the lower mold body 10 when the lower mold body 10 is separated upward from the lower mold stage 11, so that the lower mold body 10 and the guide member 17** separate upward together.

4 Claims, 5 Drawing Sheets

(51) Int. Cl.

| | |
|---|---|
| ***B22D 18/04*** | (2006.01) |
| ***B22D 17/00*** | (2006.01) |
| ***B22D 17/22*** | (2006.01) |

(56) References Cited

FOREIGN PATENT DOCUMENTS

| | | | |
|---|---|---|---|
| JP | 2005-205437 | | 8/2005 |
| JP | 2008238181 A | * | 10/2008 |
| JP | 2013-086118 | | 5/2013 |

* cited by examiner

CASTING DIE

TECHNICAL FIELD

The present invention relates to a casting die including a lower mold fixed to a base and a horizontal sliding mold which slides freely on the base.

BACKGROUND ART

Hitherto, it is known to cast a cylinder head of an engine for a vehicle by a low pressure die casting method. As a casting machine for this low pressure die casting method, it is known to adopt a configuration in which a molten metal furnace is arranged under a mold composed of an upper mold and a lower mold having a sprue, and the molten metal stored in the molten metal furnace is pushed up by applying pressure and supplied to the inside of the mold via a stoke (supply conduit) through the sprue of the lower mold.

In this type of casting machine, in a case of producing a product having a complicated shape which cannot be casted only by the upper mold and the lower mold, a horizontal sliding mold is used in addition to the upper mold and the lower mold (for example, refer to Japanese Patent Application Laid-open No. 2013-86118). As a casting machine using the horizontal sliding molds, there is known to arrange the horizontal sliding molds along the four sides of a rectangular lower mold so as to enable reciprocating motion while sliding on a rail between a mold-closing position and a mold-opening position. A lower section of the horizontal sliding mold closely contacts the lower mold, and the side section of the horizontal sliding mold closely contacts the adjacent horizontal sliding mold at the mold-closing position.

CITATION LIST

Patent Literature

Patent Literature 1: Japanese Patent Application Laid-open No. 2013-86118

SUMMARY OF INVENTION

Technical Problem

The inside of the casting machine easily becomes high temperature at the lower side where the molten metal furnace is arranged, and accordingly, the temperature of the lower mold tends to become high. As such, it is concerned that the lower mold expands by thermal expansion, and a center section of the lower mold, which is the closest part to the molten metal furnace, warps toward the upper side.

In order to prevent this warp of the lower mold, it is conceived to configure the lower mold by separating the lower mold body and the lower mold stage, and to place the lower mold body on the lower mold stage by connecting only the center section, and by not connecting the lateral edge part of the lower mold body and the lower molds stage, the influence of the warp deformation of the lower mold stage does not affect the lower mold body, thereby preventing the warp of the lower mold body.

However, although this may prevent the warp itself of the lower mold body, the lower mold body will float up from the lower mold stage by the warp of the lower mold stage. Furthermore, in a case of positioning the horizontal sliding mold by abutting to the lower mold, there is a problem that the horizontal sliding mold inclines by riding onto the floated lower mold body. In order to prevent this, eventually, it is necessary to exchange the warped lower mold to a new one.

In view of the above, it is an object of the present invention to provide a casting die capable of abutting the horizontal sliding mold to the lower mold without inclination even when the lower mold stage is warped.

Solution to Problem

[1] In order to achieve the above object, the present invention is a casting die including: a base; a lower mold arranged on the base; a horizontal sliding mold which is provided so as to be capable of moving on the lower mold and which has a surface shape corresponding to at least a part of a side face shape of a product to be casted; and an upper mold which is provided so as to be capable of moving up and down with respect to the lower mold and which has a surface shape corresponding to an upper face shape of the product; wherein, the lower mold is configured by a lower mold body and a lower mold stage which supports the lower mold body from below, the lower mold body has a positioning part which abuts the horizontal sliding mold at a mold-closing position of the horizontal sliding mold, and has a surface shape corresponding to a lower face shape of the product, a guide member is mounted on the lower mold stage so as to freely move in an up and down direction with respect to the lower mold stage, the horizontal sliding mold is configured to slide on the guide member and the lower mold body, and the guide member is provided with a locking part configured to lock with a lateral edge part of the lower mold body when the lower mold body is separated upward with respect to the lower mold stage, so that the lower mold body and the guide member are separated upward together.

In the present invention, the lower mold body is provided with the positioning part. As such, even in the case of changing the mold, it is able to cope with the change of the mold by only changing the lower mold body without changing the lower mold stage. Therefore, it is able to simplify the lower mold stage and improve the generality, thereby enabling to use the lower mold stage for a long period of time.

When using the lower mold stage for a long period of time, the lower mold stage gradually deforms by heat and the center section of the lower mold stage warps upward. If the lower mold stage warps, the lower mold body floats upward to the upper side by the warping of the lower mold stage. If the lower mold body floats upward, a difference in level is formed between the lower mold body and the lower mold stage at the portions on which the horizontal sliding mold slides. If a difference in level occurs, a state in which the horizontal sliding mold rides onto the lower mold body will be caused when sliding the horizontal sliding mold to the mold-closing position, and the horizontal sliding mold will incline.

In order to eliminate the difference in level between the lower mold body and the lower mold stage so as to prevent this inclination of the horizontal sliding mold, the present invention is configured to provide a guide member which freely moves in the vertical direction on the lower mold stage and to slide the horizontal sliding mold on the guide member of the lower mold stage. According to this, even if the lower mold body floats upward, the guide member elevates together with the lower mold body since the guide member is engaged with the lower mold body by its locking part, thereby enabling to prevent the formation of level difference between the lower mold body and the guide member provided on the lower mold stage.

[2] According to the present invention, the lower mold body is fixed to the lower mold stage via a plurality of spacers which are arranged with an interval between each other. According to such feature, it is able to adjust the elevation degree of the lower mold body with respect to the lower mold stage before the guiding member exceeds the allowable elevation limit, for example, only by exchanging the spacer or by shaving a part of the lower mold stage which contacts the spacer, thereby enabling to use the lower mold stage for even longer period of time.

[3] According to the present invention, the lower mold body includes a support plate provided on an upper face of the lower mold body, the horizontal sliding mold is configured to slide on the support plate of the lower mold body and the guide member, and an upper face of the support plate and an upper face of the guide member are set as a flush surface.

According to such configuration, it is able to form the sliding face of the horizontal sliding mold to be a smooth surface without level difference, and it becomes easy to set the sliding face.

DESCRIPTION OF EMBODIMENTS

An embodiment of a casting die of the present invention is explained with reference to FIG. 1 to FIG. 7.

Figure 1:
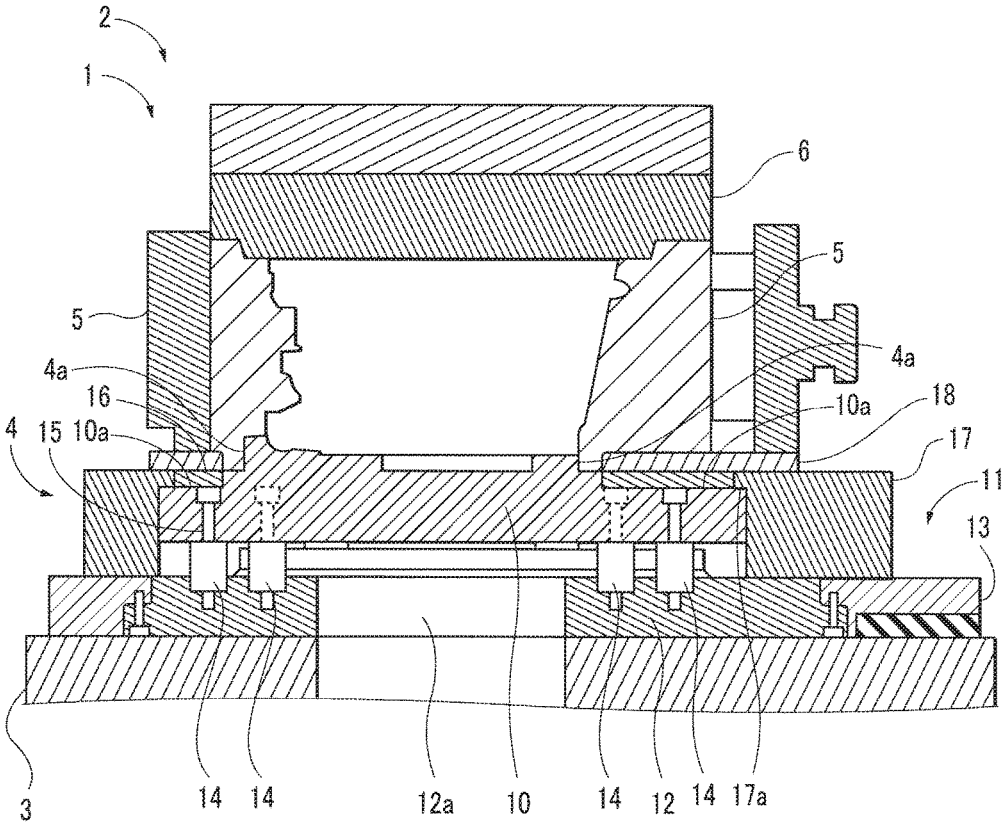
FIG. 1 is a cross-sectional diagram schematically illustrating an embodiment of a casting die of the present invention.

Referring to FIG. 1, a casting die 1 of the present embodiment configures the main part of a casting machine 2. The casting machine 2 is for casting a cylinder head of an engine for a vehicle by low pressure die casting method.

The casting machine 2 includes a base 3, and the casting die 1 is arranged on the base 3. The casting die 1 includes a lower mold 4 fixed on the base 3, four horizontal sliding molds 5 which are each arranged so as to surround the center portion of the lower mold 4 from four side faces on the lower mold 4, and an upper mold 6 arranged so as to cover the space defined by the lower mold 4 and the four horizontal sliding molds 5 from the upper side.

The four horizontal sliding molds 5 are able to freely slide along a rail (not illustrated) radially provided at the peripheral portion of the lower mold 4. The lower mold 4 is provided with a positioning part 4*a* in order to set the mold-closing position of the horizontal sliding molds 5. The four horizontal sliding molds 5 slide from the mold-opening position, and stop at the mold-closing position by abutting the corresponding positioning part 4*a*.

The lower mold 4 is provided with a sprue which is not illustrated. The base 3 is provided with a molten metal furnace which is not illustrated. Molten metal is stored in the molten metal furnace, and by pressurizing the molten metal, the molten metal is supplied to the inside of the casting die 1 via a stoke (supply conduit) through the sprue of the lower mold 4.

The lower mold 4 is formed in a rectangular shape in a plane view. An upper face of the lower mold 4 has a surface shape corresponding to a shape of a lower face of the product (cylinder head) to be casted. Inner faces of the four horizontal sliding molds 5 have a surface shape respectively corresponding to a shape of a side face of the product (cylinder head) to be casted. A lower face of the upper mold 6 has a surface shape corresponding to a shape of an upper face of the product (cylinder head) to be casted.

Figure 2:
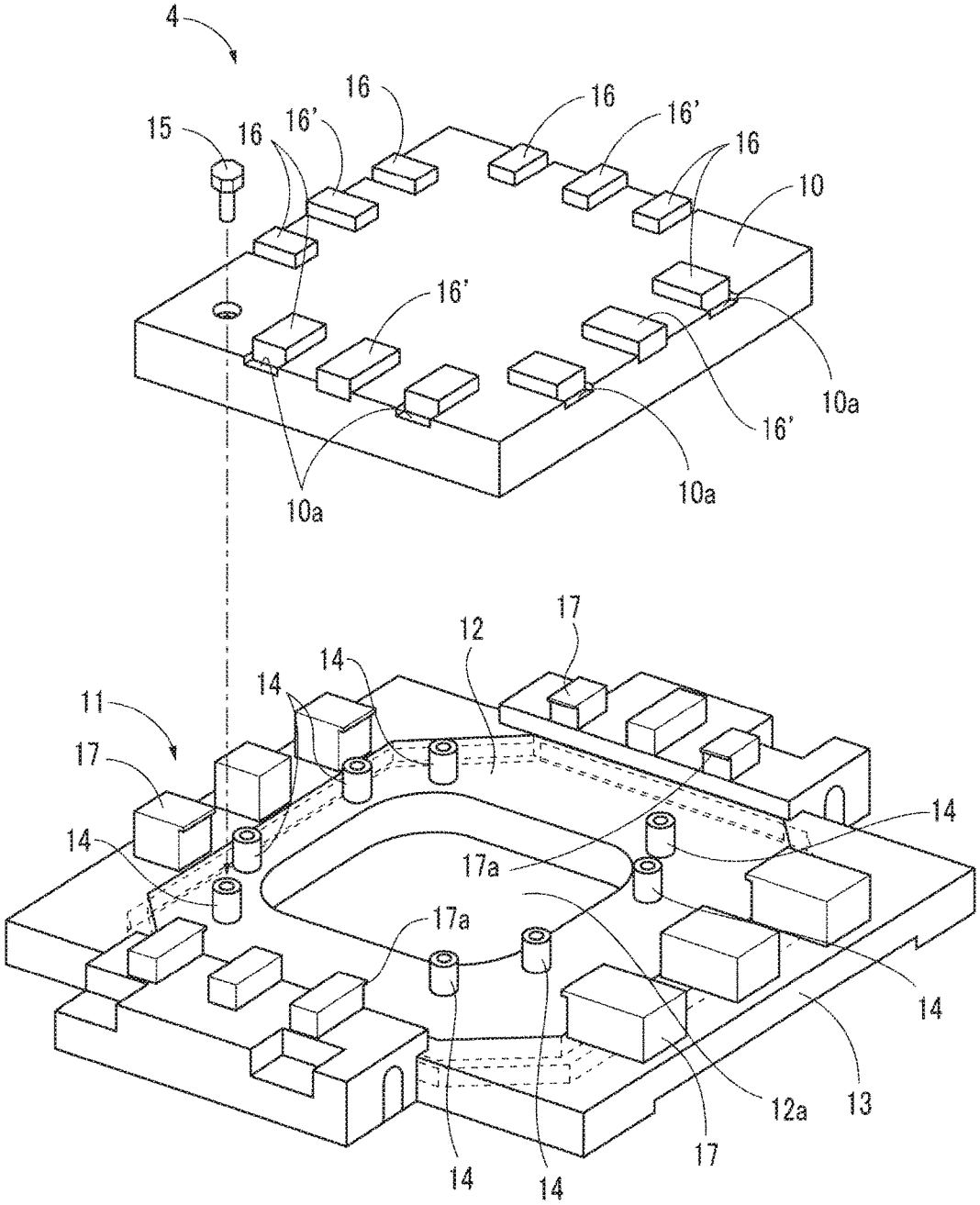
FIG. 2 is a perspective diagram schematically illustrating a lower mold of the present embodiment.

As illustrated in FIG. 2, the lower mold 4 is configured by a lower mold body 10 and a lower mold stage 11 which supports the lower mold body 10 from below. The lower mold stage 11 is configured by an adapter 12 and a frame 13 which surrounds the adapter 12 from the side face direction. A hole 12*a* for the stoke is provided at the center of the adapter 12.

Figure 3:
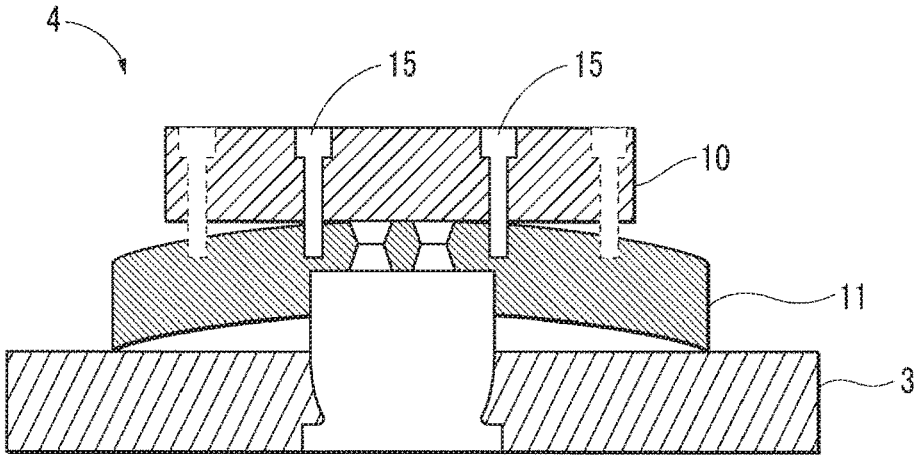
FIG. 3 is an a cross-sectional diagram schematically illustrating a connection structure of a lower mold body and a lower mold stage of the present embodiment.

As illustrated in FIG. 3, the lower mold body 10 is fixed on the adapter 12 by a plurality of (eight) bolts 15 via cylindrical spacers 14 (refer to FIG. 1 and FIG. 2). Although the spacers 14 are not illustrated in FIG. 3, the bolts 15 are screwed to the adapter 12 of the lower mold stage 11 through the inside of the cylindrical spacers 14. As illustrated in FIG. 2, the eight spacers 14 are arranged around the hole 12*a* so as to have an interval between each other. In FIG. 2, one bolt 15 is illustrated and other seven bolts are abbreviated.

Here, as shown by the dashed line in FIG. 3, when connecting the lower mold body 10 and the lower mold stage 11 by a bolt (the bolt indicated by the dashed line in FIG. 3) at the peripheral portion of the lower mold body 10, the lower mold body 10 will warp similar to the lower mold stage 11.

In this regard, in the casting die 1 of the present embodiment, the bolts 15 are arranged at the periphery of the hole 12*a* for the stoke. According to this, the lower mold body 10 is less likely to receive the influence of the deformation (warp) of the lower mold stage 11 caused by the thermal expansion due to the heat of the molten metal furnace, compared to the case of connecting the lower mold body 10 and the lower mold stage 11 by a bolt (the bolt indicated by the dashed line in FIG. 3) at the peripheral portion of the lower mold body 10.

Figure 4:
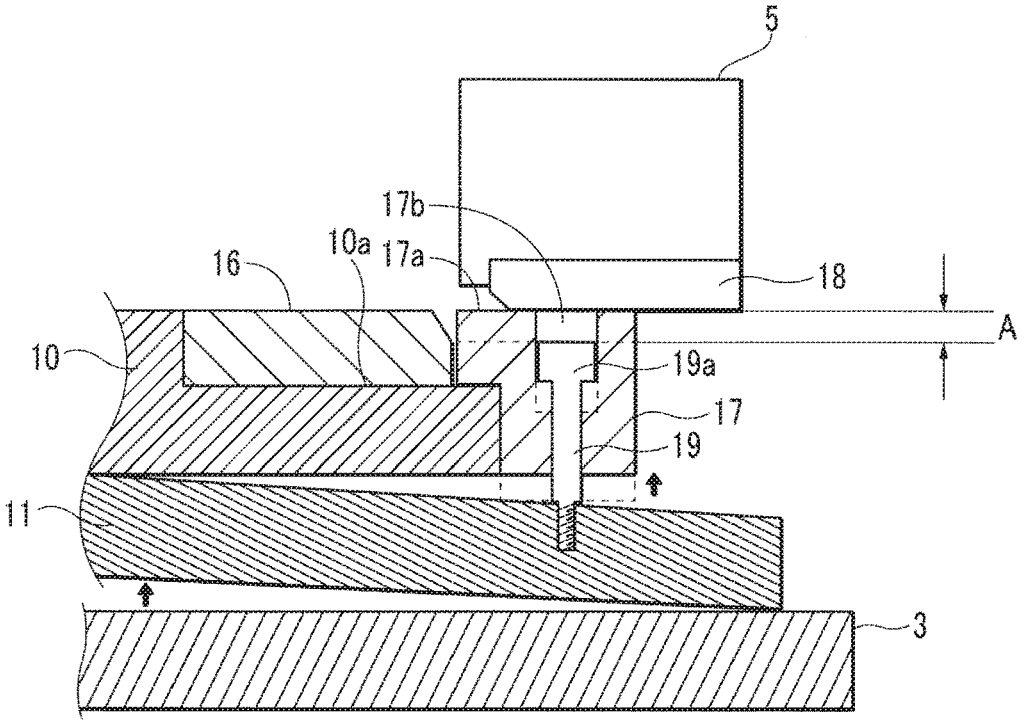
FIG. 4 is a cross-sectional diagram schematically illustrating a guide member of the present embodiment.

As illustrated in FIG. 4, at the lateral edge of the lower mold body 10, two cutout parts 10*a* which are cutout in an L-shape in cross section viewed from the side, are provided for each side of the lower mold body 10 (refer to FIG. 2). A support plate 16 is provided at the cutout part 10*a*. The support plate 16 is formed smaller than the cutout part 10*a*, and the support plate 16 and the cutout part 10*a* re configured such that the outer side (right side of the figure in FIG. 4) of the cutout part 10*a* exposes when the support plate 16 is attached to the cutout part 10*a*.

Here, at the center of the two support plates 16 provided at each side of the lower mold body 10, a moving-direction restricting member 16' which prevents the horizontal sliding mold 5 from moving to a direction different from the moving direction, is provided. An U-shaped member (not illustrated) provided at the lower face of the horizontal sliding mold 5 engages with the moving-direction restricting member 16' in the lateral direction (a direction orthogonal to the moving direction of the horizontal sliding mold 5 on a plane surface of the lower mold body 10). By this, the horizontal sliding mold 5 is prevented from moving in a direction different from the moving direction.

Moreover, in the present embodiment, although the case of providing the cutout part 10*a* has been explained, the cutout part 10*a* may be abbreviated and the support plate 16 may be directly provided on the upper face of the lower mold body 10. In such case, support plate 16 should be arranged so that the lateral edge part of the lower mold body 10 is exposed.

Moreover, a plurality of guide members 17 are mounted on the lower mold stage 11 so as to surround the lower mold body 10 from the side face. The horizontal sliding mold 5 slides on the guide member 17. A slide plate 18 is provided at the lower face of the horizontal sliding mold 5.

The guide member 17 is attached to the lower mold stage 11 (the adapter 12 or the frame 13) via a stripper bolt 19 so as to be movable in the up and down direction to a small extent. A head receiving part 17*b*, which houses the head part 19*a* of the stripper bolt 19 so as to be movable in the up and down direction, is provided at the guide member 17 so as to be capable of moving in the up and down direction with respect to the stripper bolt 19. The reference A indicated in FIG. 4 is an allowable stroke of the stripper bolt 19. A locking part 17*a* which protrudes toward the lower mold body 10 side and engages with the upper face of a portion of the cutout part 10*a* exposing from the support plate 16, is provided at the guide member 17.

As above, by forming the support plate 16 smaller than the cutout part 10*a*, and engaging the locking part 17*a* with the portion of the cutout part 10*a* exposing from the support plate 16, it is not necessary to separately provide a dedicated portion for engaging with the locking part at the lower mold body 10, thereby enabling to engage the locking part 17*a* with the lower mold body 10 only by forming the support plate 16 to be small. Here, in the case of abbreviating the cutout part 10*a* and providing the support plate 16 directly on the upper face of the lower mold body 10, the locking part 17*a* may be engaged with the lateral edge part of the upper face of the lower mold body 10.

According to the casting die 1 of the present embodiment, as described above, by attaching the guide member 17 to the lower mold stage 11 (adapter 12 or the frame 13) by a stripper bolt 19 so as to be freely movable in the up and down direction, and also by engaging the locking part 17*a* of the guide member 17 to the upper face of the cutout part 10*a*, even if the lower mold stage 11 deforms by heat expansion, and the lower mold body 10 floats upward and separates from the lower mold stage 11, the guide member 17 also floats upward together with the lower mold body 10 and separates from the lower mold stage 11. Therefore, it is able to prevent the change of relative position of the lower mold body 10 and the guide member 17 by the allowable stroke of the stripper bolt 19. In the present embodiment, the cutout part 10*a* corresponds to the lateral edge part of the lower mold body of the present invention.

Accordingly, it is able to prevent a level difference from being formed between the guide member 17 and the lower mold body 10, to prevent the inclination of the posture and the malfunction of the horizontal sliding mold 5 due to formation of the level difference, and to prevent any offset load from being applied to the actuator (not illustrated) of the horizontal sliding mold 5.

In the present embodiment, the casting die 1 in which the lower mold body 10 includes a support plate 16 at the upper face of the lower mold body 10, and both of the upper faces of the support plate 16 and the guide member 17 are set as a flush surface, has been explained. By arranging the upper faces of the support plate 16 and the guide member 17 as a flush surface, the sliding face provided at the lower face of the horizontal sliding mold 5, which slides on both of the upper faces of the support plate 16 and the guide member 17, can be formed as a smooth surface without having any level difference, thereby making it easy to set the sliding face. However, the casting die 1 of the present invention is not limited to such configuration.

For example, even if the support plate 16 and the guide member 17 already have a level difference, it may be configured such that the horizontal sliding mold 5 is provided with a corresponding level difference in advance so that the horizontal sliding mold 5 does not incline. As such, even if the support plate 16 and the guide member 17 have a level difference beforehand, it is able to obtain the effect of the present invention to prevent the change of the relative positional relationship between the support plate 16 and the guide member 17 by the deformation of the lower mold stage 11 due to thermal expansion.

Figure 5:
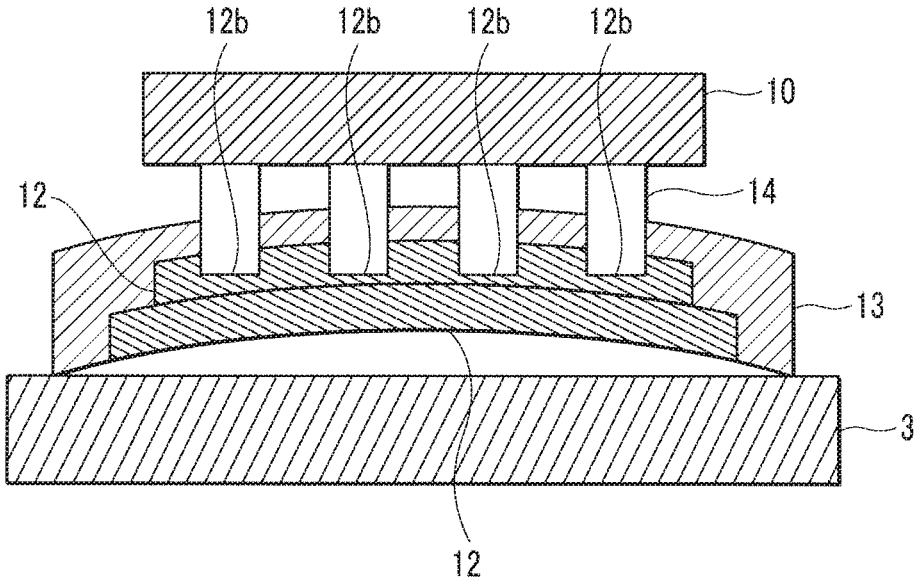
FIG. 5 is a schematic diagram of a case of adjusting an interval between the lower mold body and the lower mold stage by shaving a portion of the lower mold stage which contacts a spacer in the present embodiment.
Figure 6:
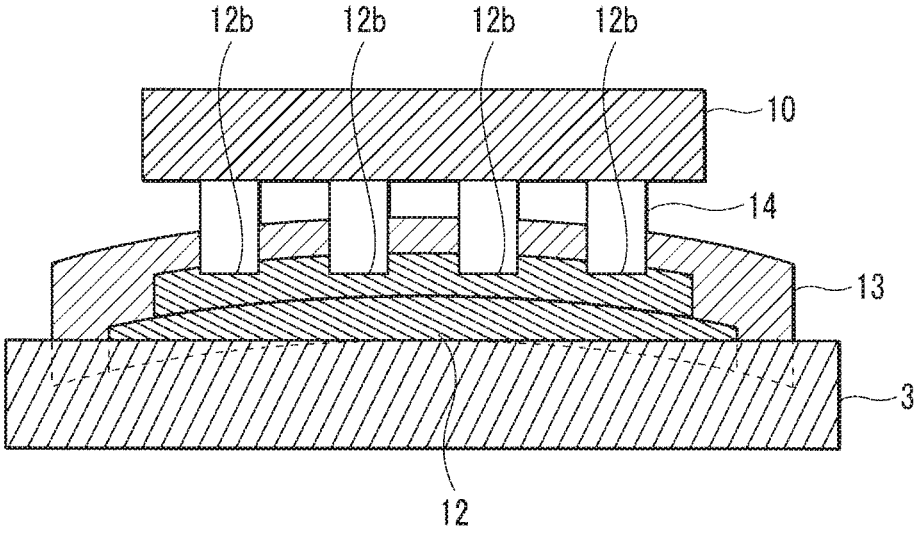
FIG. 6 is a schematic diagram of a case of adjusting the interval between the lower mold body and the lower mold stage by exchanging the spacer in the present embodiment.
Figure 7:
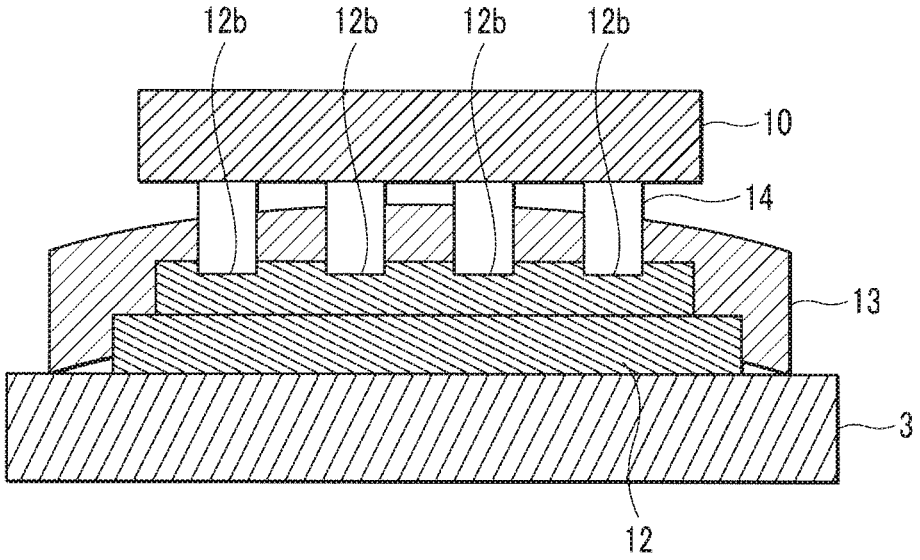
FIG. 7 is a schematic diagram of a case of adjusting the interval between the lower mold body and the lower mold stage by exchanging an adapter of the lower mold stage in the present embodiment.

Next, referring to FIG. 5 to FIG. 7, the countermeasure is explained for the case when it becomes unable to cope with the raise of the lower mold body 10 according to the deformation of the lower mold stage 11 due to thermal expansion, only by raising the guide member 17.

FIG. 5 shows a method of processing the bearing surface 12*b* provided at the adapter 12 for positioning the spacer 14 by cutting or the like. It is able to adjust the height of the lower mold body 10 with respect to the lower mold stage 11 at a relatively low cost, since it is possible to manage only by the processing of more deeply cutting the beating surface 12*b* of the adapter 12.

FIG. 6 shows a method of adjusting the height of the lower body mold 10 by cutting the bottom surfaces of the adapter 12 and the frame 13 so as to be flat and exchanging the spacer 14 with a new one in accordance with the warp of the upper face of the lower mold stage 11, and also by processing the beating surface 12*b* of the adapter 12 so as to be flat. In the method of adjusting the height of FIG. 6, it is necessary to arrange spacers 14 having different heights corresponding to the warp of the lower mold stage 11.

In this regard, although the method of adjusting the height of FIG. 6 is a little troublesome compared to the method of FIG. 5, it also enables to adjust the height of the lower mold body 10 by using the spacers 14, and enables to appropriately slide the horizontal sliding mold 5 on the lower mold 4 without exchanging the adapter 12 or the frame 13 even in the case where the lower mold body 10 raises exceeding an allowable stroke of the stripper bolt 19 due to the warp of the lower mold stage 11 caused by the thermal expansion.

FIG. 7 shows a method of adjusting the height by exchanging the adapter 12 with a new one. According to this method, it is able to adjust the height by returning the height of the lower mold body 10 to the original state without exchanging the spacer 14. Moreover, since the frame 13 is used in the warped state, it is able to suppress the cost required for adjusting the height of the lower mold body 10 compared to the case of exchanging the whole lower mold stage 11.

DESCRIPTION OF REFERENCE NUMERALS

1 casting die
2 casting machine

3 base
4 lower mold
4*a* positioning part
5 horizontal sliding mold
6 upper mold
10 lower mold body
10*a* cutout part (lateral edge part)
11 lower mold stage
12 adapter
12*a* hole
12*b* bearing surface
13 frame
14 spacer
15 bolt
16 support plate
17 wide member
17*a* locking part
17*b* head receiving part
18 slide plate
19 stripper bolt
19*a* head part
A allowable stroke

The invention claimed is:

1. A casting die comprising:

a base;

a lower mold arranged on the base;

a horizontal sliding mold which is provided so as to be capable of moving on the lower mold and which has a surface shape corresponding to at least a part of a side face shape of a product to be casted; and an upper mold which is provided so as to be capable of moving up and down with respect to the lower mold and which has a surface shape corresponding to an upper face shape of the product; wherein, the lower mold is configured by a lower mold body and a lower mold stage which supports the lower mold body from below, the lower mold body has a positioning part which abuts the horizontal sliding mold at a mold-closing position of the horizontal sliding mold, and has a surface shape corresponding to a lower face shape of the product, a guide member is mounted on the lower mold stage so as to freely move in an up and down direction with respect to the lower mold stage, the horizontal sliding mold is configured to slide on the guide member and the lower mold body, and the guide member is provided with a locking part configured to lock with a lateral edge part of the lower mold body when the lower mold body is separated upward with respect to the lower mold stage, so that the lower mold body and the guide member are separated upward together.

2. The casting die according to claim 1, wherein the lower mold body is fixed to the lower mold stage via a plurality of spacers which are arranged with an interval between each other.

3. The casting die according to claim 2, wherein, the lower mold body includes a support plate provided on an upper face of the lower mold body, the horizontal sliding mold is configured to slide on the support plate of the lower mold body and the guide member, and an upper face of the support plate and an upper face of the guide member are set as a flush surface.

4. The casting die according to claim 1, wherein, the lower mold body includes a support plate provided on an upper face of the lower mold body, the horizontal sliding mold is configured to slide on the support plate of the lower mold body and the guide member, and an upper face of the support plate and an upper face of the guide member are set as a flush surface.

* * * * *